United States Patent [19]

Ishibashi

[11] Patent Number: 4,891,951

[45] Date of Patent: Jan. 9, 1990

[54] REFRIGERATION SYSTEM

[75] Inventor: Kiyoshi Ishibashi, Toyota, Japan

[73] Assignee: Aisin Seiki Kabushiki Kaisha, Aichi Pref., Japan

[21] Appl. No.: 290,428

[22] Filed: Dec. 27, 1988

[30] Foreign Application Priority Data

Dec. 26, 1987 [JP] Japan ..... 62-331476

[51] Int. Cl.[4] ..... F25B 19/00

[52] U.S. Cl. ..... 62/51.3

[58] Field of Search ..... 62/467, 514 R

[56] References Cited

U.S. PATENT DOCUMENTS 3,845,636 11/1974 Van Mal et al. ..... 62/514 R
4,499,737 2/1985 Binnig et al. ..... 62/514 R
4,700,545 10/1987 Ishibashi et al. ..... 62/467

FOREIGN PATENT DOCUMENTS 618570 1/1986 Japan .

*Primary Examiner*—Ronald C. Capossela
*Attorney, Agent, or Firm*—Oblon, Spivak, McClelland, Maier & Neustadt

[57] ABSTRACT

A refrigeration system includes a compression portion having a volume to be varied, a heat-accumulator fluidically connected to the compression portion, a condenser fluidically connected to the heat-accumulator and having an upper side and a lower side, an expansion portion having a volume to be varied at which a very low temperature is generated, a vessel containing an amount of liquid helium and having vapor phase of helium above the liquid helium, a first conduit for connecting the vapor phase of helium in the vessel and the upper side of the condenser, and a second conduit for connecting the liquid helium in the vessel and the lower side of the condenser. In such a system, since the compression portion is in fluid communication with the vessel via a first conduit and a second conduit, the substance immersed in the liquid helium in the vessel may be isolated from vibrations or magnetism from the compression portion by setting the length of each conduit at a suitable value. Further, since the introduction of vapor helium into the condenser is performed by convection and the liquid helium is returned to the vessel by gravity, the carrying or transfer of helium may be performed without a device such as a pump.

6 Claims, 3 Drawing Sheets

REFRIGERATION SYSTEM

BACKGROUND OF THE INVENTION

1. Field of the Invention:

The present invention relates to a refrigeration system for generating a low temperature, and more particularly to a refrigeration system having a vessel in which an amount of liquid helium is contained for cooling a substance such as a superconducting magnet or a Josefson-element.

2 Description of the Related Art:

A conventional refrigeration system of this kind is disclosed, for example, in Japanese Patent Laid-Open Publication No. 61-8570 published without examination on January 16, 1986. In this refrigeration system, a condenser is disposed in a vessel in which an amount of liquid helium is stored as a coolant for refrigerating a substance. Gaseous helium or evaporated helium within the vessel is condensed into liquid helium by the condenser, thereby keeping the level of the liquid helium constant.

However, in the above conventional refrigeration system, the condenser is adjacent to an expansion cylinder at which a very low temperature is generated, with the result that it is difficult to cool a specific substance such as a superconducting magnet or a Josefson-element which must not be affected by vibrations or magnetism.

SUMMARY OF THE INVENTION

It is therefore an object of the present invention to provide an improved refrigeration system without the aforementioned drawback.

It is another object of the present invention to provide an improved refrigeration system which is able to refrigerate a specific substance such as a superconducting magnet or a Josefson-element which must not be affected by vibrations or magnetism.

It is a further object of the present invention to provide an improved refrigeration system in which a vessel containing therein an amount of liquid helium is separated from an expansion cylinder.

In order to carry out the above, and other, objects, the present invention provides a refrigeration system including a compression portion having a volume to be varied, a heat accumulator fluidically connected to the compression portion, a condenser fluidically connected to the heat accumulator and having an upper side and a lower side, an expansion portion fluidically connected to the condenser and having a volume to be varied at which a very low temperature is generated, a vessel containing an amount of liquid helium and having a vapor phase of helium above the liquid helium, a first conduit for connecting the vapor phase of helium in the vessel and the upper side of the condenser, the condenser being external to the vessel, and a second conduit for connecting the liquid helium in the vessel and the lower side of the condenser. The vapor phase is condensed in the condenser and return to the vessel while vibrations and magnetism generated at the compression and expansion portions do not reach the vessel.

BRIEF DESCRIPTION OF THE DRAWINGS

Additional objects and advantages of the present invention will become more apparent from the following detailed description of preferred embodiments thereof when considered with reference to attached drawings, in which.

DESCRIPTION OF THE PREFERRED EMBODIMENTS

A refrigeration system constituted in accordance with preferred embodiments of the present invention will be described with reference of the drawings.

Figure 1:
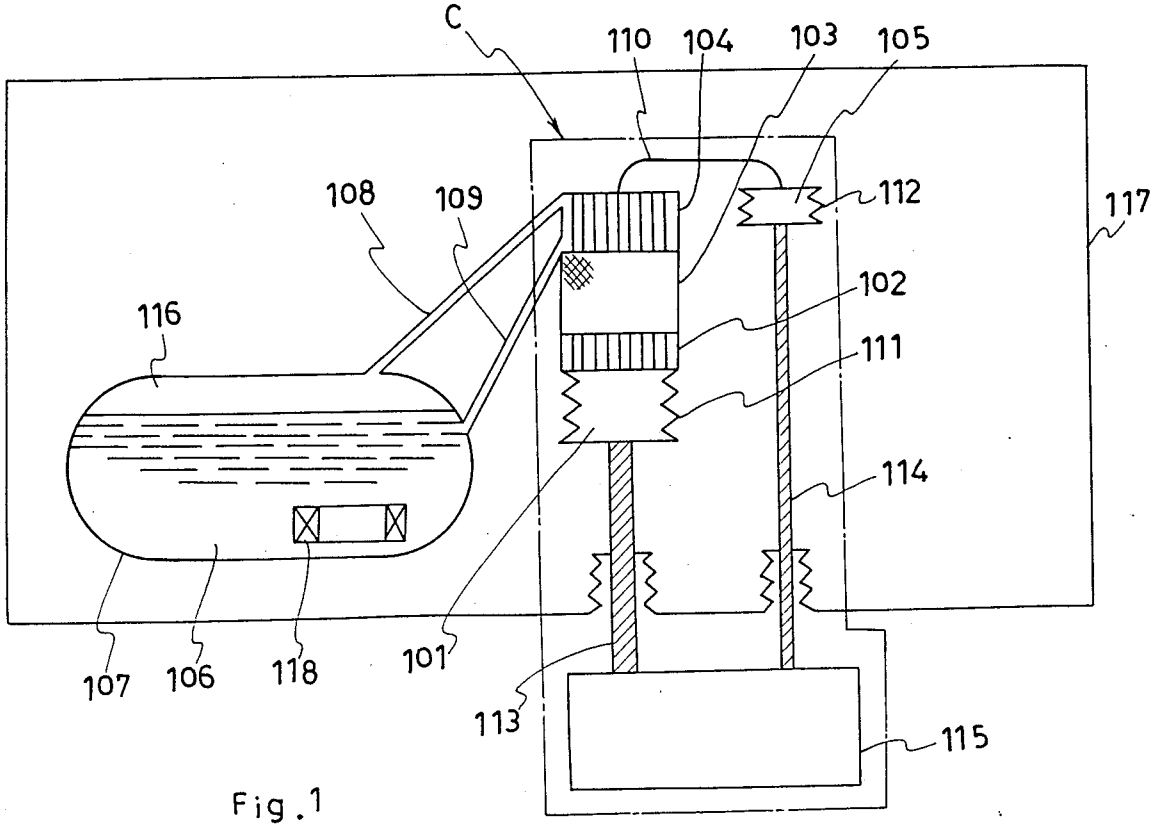
FIG. 1 is a schematic view illustrating a first embodiment of a refrigeration system according to the present invention.

First of all, referring to FIG. 1, a compression portion 101 which is formed by a bellows 111 is in fluid communication with an expansion portion 105 which is formed by a bellows 112 via a heat radiation apparatus 102, heat-accumulator 103, a condenser 104 and a conduit 110. The bellows 111 and 112 are connected to rods 113 and 114, respectively. Rods 113 and 114 are driven, with a predetermined phase difference, by a driver 115.

Thus, a refrigerating machine C is constituted and a very low temperature is generated at the expansion portion 105. In refrigerating machine C, a gaseous helium is used as a refrigeration medium which is enclosed in a fluid circuit defined between the compression portion 101 and the expansion portion 105, as is well-known.

In a vacuum casing 117 are positioned a vessel 107 and the refrigerating machine C, except for the driver 115. An amount of liquid helium 106 is stored in the vessel 107 and a vapor phase 116 is defined above the liquid helium 106. A substance 118 to be cooled such as a superconductive magnet, a Josefson element or the like is immersed in the liquid helium 106.

The vessel 107 is in fluid communication with the condenser 104 via a first conduit 108 and a second conduit 109. An end portion of the first conduit 108 at the condenser 104 is located at a position which is higher than a position at which an end portion of the second conduit 109 at the condenser 104. On the other hand, an end portion of the first conduit 108 at the vessel 107 is in fluid communication with the vapor phase 116 in the vessel 107 and an end of the second conduit 109 at the vessel 107 is in fluid communication with the liquid helium 106 in the vessel 107.

In operation, upon actuation of the driver 115, the bellows 111 is shortened in the axial direction thereof and the volume of the compression portion 101 is decreased. Thereby, the gaseous helium in the compression portion 101 is compressed and this compressed helium is introduced, in turn, into the radiation apparatus 102 where it is cooled and liquefied, the heat-accumulator 103, the condenser 104 and the expansion portion 105. At this time, since the bellows 112 is stretched by the rod 114 and is further stretched by the rod 114 after the stretching of the bellows 111 by the rod 113, the compressed helium is expanded in the expansion portion 105 and low temperature is generated thereat. After this operation, the bellows 112 is shortened by the rod 114 and the helium in the expansion portion 105 is introduced into the heat-accumulator 103 via the condensation apparatus 104. At this time, the helium refrigerates the heat-accumulator 103 and is evaporated. The gaseous helium is then reintroduced into the compression portion 101 via the radiation apparatus 102. Thereby, one-cycle ends and this cycle is repeated thereafter.

In the above cycle, the average value of the temperature of the helium which flows in the condenser 104 of the refrigerating machine C is lower than the temperature (for example, 4.4K) of the vapor of the liquid-helium 106. Since heat enters the vessel 107, the liquid-helium 106 in the vessel 107 evaporates and increases the pressure in the vessel 107. But since the vapor of the liquid-helium in the vapor phase 116 in the vessel 107 is introduced to the condenser 104 via the first conduit 108, it is there cooled and condensed in the condenser 104, and returned to the vessel 107 via the second conduit 109.

As mentioned above, according to the present invention, since the refrigerating machine C is in fluid communication with the vessel 107, the substance 118 may be isolated from vibrations or magnetism from refrigerating machine C by setting the length of each conduit 108, 109 at a suitable value. Further, since the introduction of helium vapor into the condenser 104 is performed by convection and the liquid helium is returned to the vessel 107 by gravity, transfer of helium may be performed without a device such as a pump.

Figure 2:
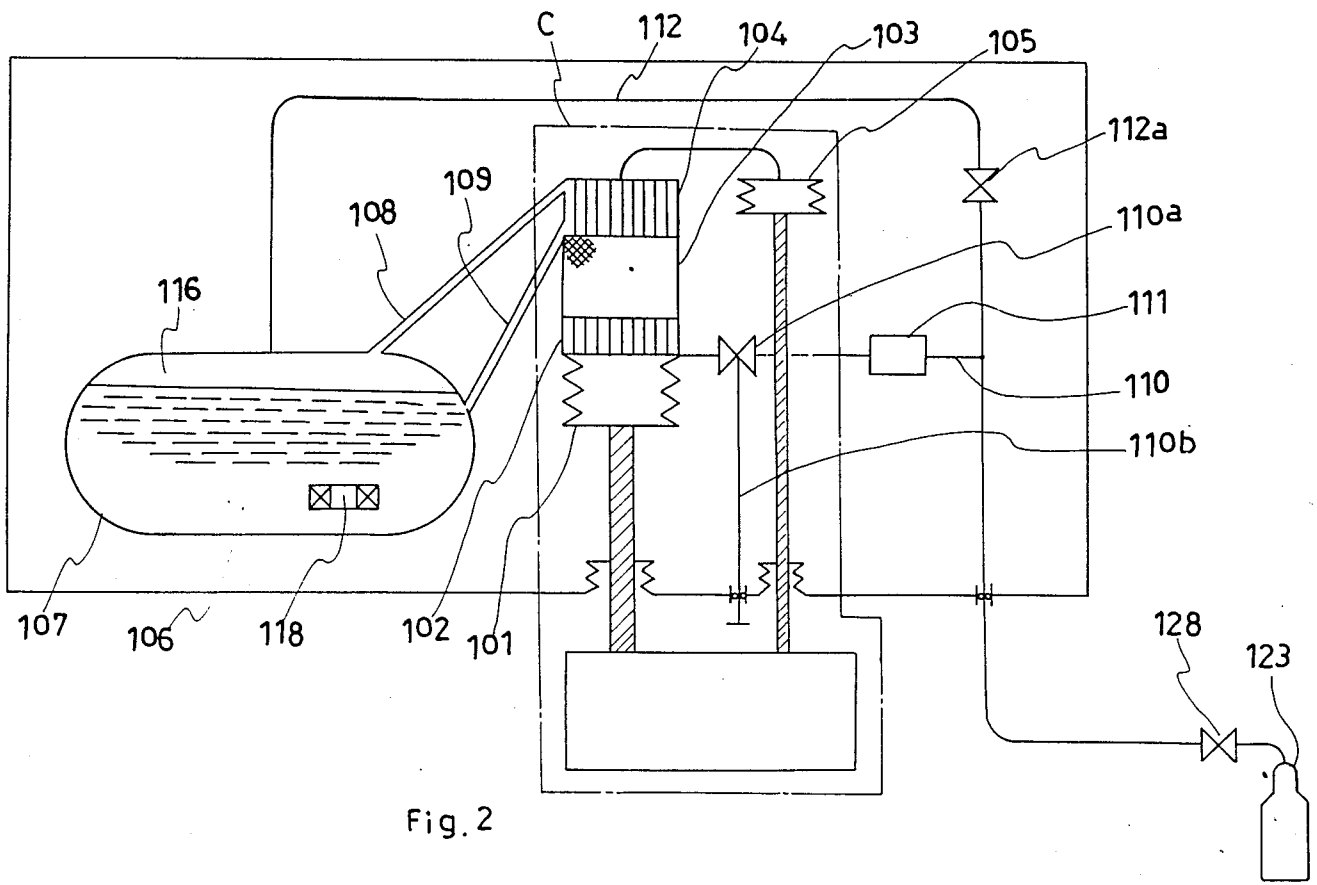
FIG. 2 is a schematic view illustrating a second embodiment of a refrigeration system according to the present invention.

In addition, as shown in FIG. 2, for keeping the pressure of the gaseous helium which is used as the refrigerating medium at a constant value, the compression portion 101 is fluidically connected to the vapor phase 116 in the vessel 107 via a third conduit 112 having a valve **112*a* and a connecting conduit 110 having a filter 111 and an orifice valve 110*a* which can be manually adjusted by control handle 110*b*. During operation of the refrigerating machine C, gaseous helium is supplied to the compression portion 101 from the vessel 107 via conduit 112 at a rate controlled by valve 112*a* and orifice valve 110*a***.

Gaseous helium can also be supplied to the compression portion from helium storage tank 123, via valve 128.

Figure 3:
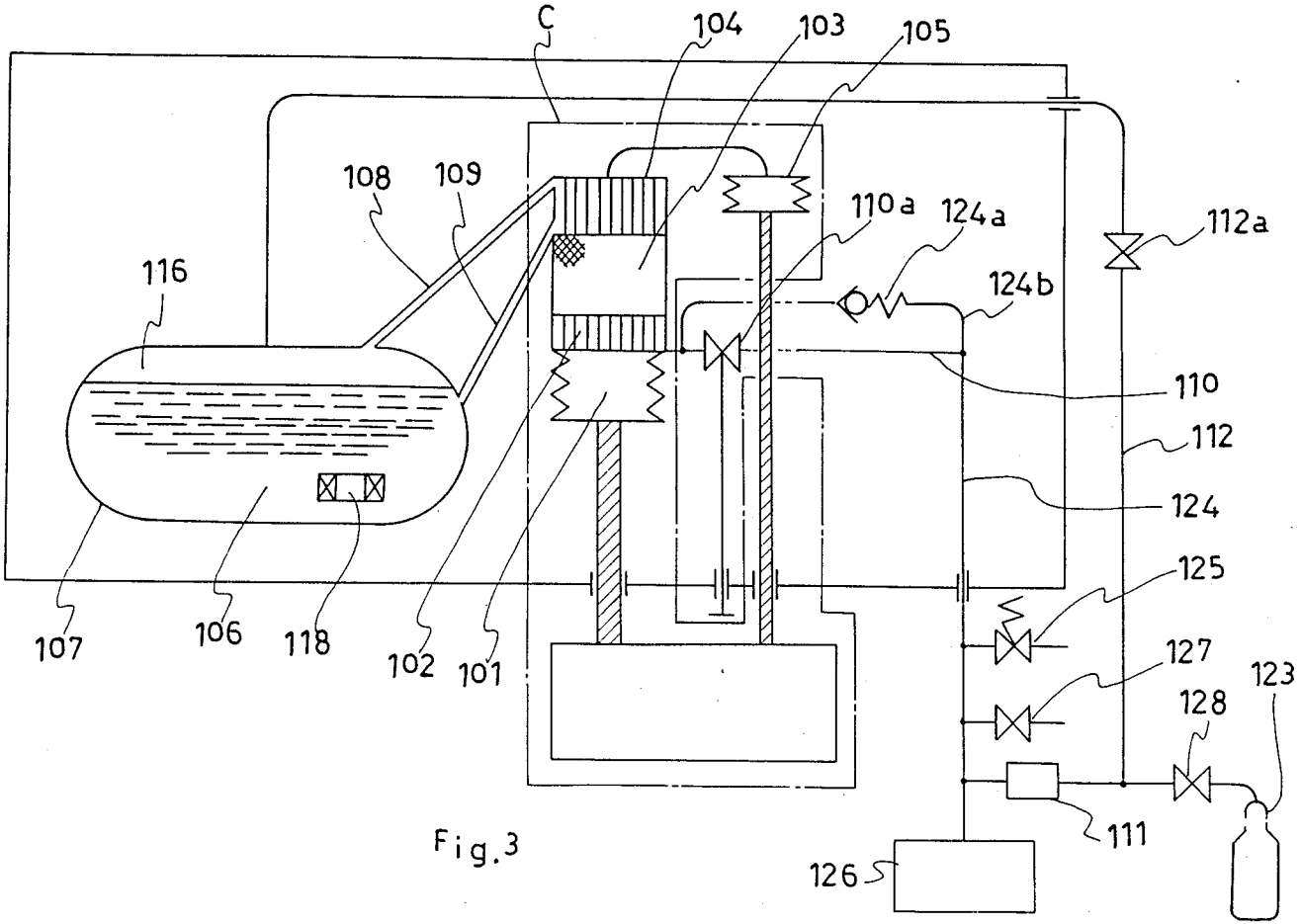
FIG. 3 is a schematic view illustrating a third embodiment of a refrigeration system according to the present invention.

The embodiment shown in FIG. 3 corresponds to that of FIG. 2, with the following exceptions. In this embodiment, the compression portion 101 does not connect directly to the third conduit 112 extending between the vessel 107 and the helium storage tank 123, but instead connects to a parallel conduit 124. In particular, the connecting conduit 110 having the orifice valve **110*a* connects between the compression portion 101 and the parallel conduit 124. Moreover, a relief valve 124*a* is formed in a bypass conduit 124*b*, parallel to the orifice valve 110*a*, for preventing excess pressure build-up in the compression portion 101**.

A buffer tank 126 is connected to the parallel conduit 124 in order to balance out gaseous helium pressure fluctuations.

In this embodiment, the filter 111 is positioned in the parallel conduit 124, as are a further pressure relief valve 125 for preventing the supply of gaseous helium under a high pressure to the refrigerating machine C, and a valve 127 which is opened for exhausting gaseous helium from the refrigerating machine C during maintenance thereof.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A refrigeration system comprising:

a compression portion having a volume to be varied;

a heat-accumulator fluidically connected to said compression portion;

a condenser fluidically connected to said heat-accumulator and having an upper side and a lower side;

an expansion portion fluidically connected to said condenser and having a volume to be varied, at which a very low-temperature is generated;

a vessel containing an amount of liquid helium and having a vapor phase of helium above said liquid helium, said condenser being external to said vessel;

a first conduit for connecting said vapor phase of helium in said vessel and said upper side of said condenser;

a second conduit for connecting said liquid helium in said vessel and said lower side of said condenser, whereby said vapor phase is condensed in said condenser and returned to said vessel.

2. A refrigeration system according to claim 1 including a third conduit connected to said vessel, said third conduit having a valve and an orifice and fluidically communicating said compression portion with said vapor phase in said vessel.

3. A refrigeration system according to claim 2 including a relief valve provided parallel to the said valve.

4. A refrigeration system according to claim 1 including drive means for varying the volumes of said compression portion and said expansion portion out of phase with one anther.

5. A refrigeration system according to claim 1 wherein lengths of said first and second conduits are sufficient that vibrations and magnetism generated at said compression and expansion portions do not reach said vessel.

6. A refrigeration system according to claim 1 wherein ends of said first and second conduits at said condenser are positioned higher than respective ends of said first and second conduits at said vessel, whereby said vapor phase is transferred to said condenser by convection and condensed helium is returned to said vessel by gravity.

* * * * *